United States Patent [19]

Stille

[11] 4,374,621

[45] Feb. 22, 1983

[54] APPARATUS FOR CONTROLLING POWER DELIVERY TO A GRAIN STIRRING DEVICE

[75] Inventor: Larry Stille, Rockford, Iowa

[73] Assignee: David Manufacturing Company, Mason City, Iowa

[21] Appl. No.: 315,970

[22] Filed: Oct. 28, 1981

[51] Int. Cl.[3] ..... B01F 7/24; B01F 7/30

[52] U.S. Cl. ..... 366/261; 366/287; 366/601

[58] Field of Search ..... 366/261, 84, 287, 86, 366/83, 292, 241, 297, 281-284, 287-289, 202, 203, 210, 212, 297-301, 601, 603

[56] References Cited

U.S. PATENT DOCUMENTS

| | | | |
|---|---|---|---|
| 3,156,541 | 11/1964 | Kalke | 366/261 |
| 3,251,582 | 5/1966 | Murphy | 366/261 |
| 3,272,480 | 9/1966 | Sukup | 366/261 |
| 3,410,537 | 11/1968 | Feinhold | 366/261 |
| 3,580,549 | 5/1971 | Murphy | 366/261 |

*Primary Examiner*—Philip R. Coe
*Assistant Examiner*—Timothy F. Simone
*Attorney, Agent, or Firm*—Merchant, Gould, Smith, Edell, Welter & Schmidt

[57] ABSTRACT

Apparatus for controlling delivery of power to a grain stirring apparatus is disclosed. A bridge frame (21) is supported between a shaft (34) and a circular track (24) on the wall (11) of bin (10). Frame (21) supports a trolley mechanism (45) having a rotating auger (47) operatively attached thereto. Frame (21) moves orbitally around bin (10) as trolley (45) moves radially inward and outward thereby allowing auger (47) to stir grain (12).

The apparatus for controlling power delivery has a switch (151) which senses orbital movement using roller (191) to follow cam (190) fastened to shaft (34). If orbital movement is not appropriately sensed, timer (117) causes relays (119) and (133) to open thereby powering off grain stirring apparatus (20).

5 Claims, 7 Drawing Figures

APPARATUS FOR CONTROLLING POWER DELIVERY TO A GRAIN STIRRING DEVICE

Field of the Invention

This invention pertains to the field of grain stirring devices, and more particularly pertains to an apparatus for automatically powering off the stirring device in the absence of forward movement of the stirring mechanism for a predetermined length of time.

BACKGROUND OF THE INVENTION

It is current practice to dry grain or other like materials by placing same in a cylindrical container and forcing heated air upwardly therethrough. Various methods, such as batch drying and layer drying have been developed to overcome problems encountered in such drying operations. Both such methods are inefficient since considerable time and labor is required. Additionally, problems such as uneven drying, incomplete drying, and crusting of the upper surface further complicate such drying operations and may result in insect infestation and/or spoilage. A more efficient method is deep-bed drying, wherein the container or bin is substantially filled with grain and a stirring device, such as that disclosed in U.S. Pat. No. 3,251,582 and U.S. Pat. No. 3,580,549, is used to constantly stir or mix the grain throughout the drying cycle. Such devices are normally constructed to travel a predetermined path circumferentially and radially within the container during the drying cycle thereby overcoming the above problems.

A new problem has arisen, however, in the case when a stirring device operates in a stationary position for a substantial length of time. Such operation results in overstirring and possible damage of grain surrounding the mechanism. With the typical two motor grain stirring mechanism in which a first motor drives the stirring unit in an orbital and radial path around the bin, and a second motor powers the stirring mechanism, the above-described problem can occur as a result of failure of the first motor, malfunctions in the drive linkage, or obstructions.

Unlike prior art systems, the present invention provides an apparatus for continually monitoring the orbital movement of the stirring mechanism support structure and automatically powering off the motors in the absence of orbital movement after a predetermined time period. In this manner the present invention avoids needless damage to the material contained within the container and conserves electrical energy for more productive uses.

SUMMARY OF THE INVENTION

The present invention comprises apparatus for controlling delivery of power to a stirring device mounted in a grain storage bin. The device has means for stirring grain and means for moving the stirring means about the interior of the bin. The stirring means and the moving means are driven by the indicated power. The apparatus comprises means for sensing movement of the moving means and means for interruptably connecting the power to said stirring means, said stirring means being controlled by the sensing means. In this fashion, when the sensing means senses absence of movement of the moving means, after a predetermined time period, the connecting means interrupts power to the stirring means thereby protecting the grain from harmful overstirring.

In a preferred embodiment, the grain stirring device has a central shaft and an auger support mechanism depending radially therefrom to the wall of a bin. A pair of motors drive an auger and drive the supporting mechanism orbitally around the central shaft. The present invention senses movement or absence of movement of the supporting mechanism. The sensing mechanism is comprised of a cam fixedly attached to the stationary central shaft and a microswitch attached to the auger support structure which rotates about the shaft. The microswitch has a cam follower which causes the switch to be periodically activated as the support mechanism rotates about the central shaft. Actuation of the switch causes a solid state timer to reset a predetermined time interval. The timer is connected to a relay. If the time interval times out without being reset, the relay opens, thereby disconnecting the power to the motors, which causes stirring to cease.

As long as the auger support mechanism continues to orbit about the bin, the switch will continually be actuated causing the timer to continually reset thereby keeping power connected to the drive motors. The present invention is particularly advantageous, therefore, since any malfunction or obstruction that stops orbital movement of the stirring mechanism structure prevents actuation of the switch thereby allowing the timer to time out and the relays to open so as to power down the drive motors. Thus, the present invention prevents damage to the drive motors and to the grain. More particularly, excessive stirring of a small portion of grain will cause cracking or grinding of the grain, which may result in heating or loss of market value and nutritional quality. Thus, the present invention not only protects the grain stirring device, but also protects the quality of the grain product which the grain stirring device is designed to otherwise enhance.

These advantages and other objects obtained by the use of the present invention may be better understood by reference to the drawings which form a further part of this disclosure and to the accompanying descriptive matter in which there is illustrated and described in more detail a preferred embodiment of the invention.

BRIEF DESCRIPTION OF THE DRAWINGS

Reference numerals designate identical or corresponding parts throughout the several views in the drawings as follows.

DETAILED DESCRIPTION OF THE PREFERRED EMBODIMENT

Figure 1:
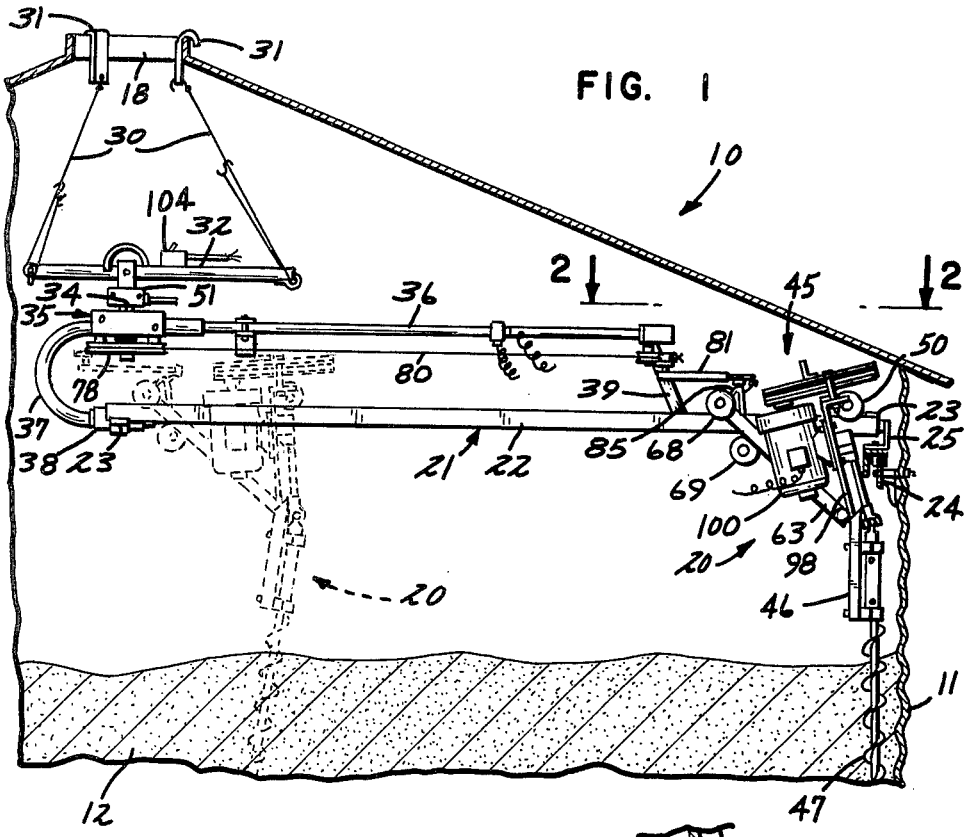
FIG. 1 shows a side elevational view of a grain bin having a stirring apparatus with an automatic power off device in accordance with the present invention.
Figure 2:
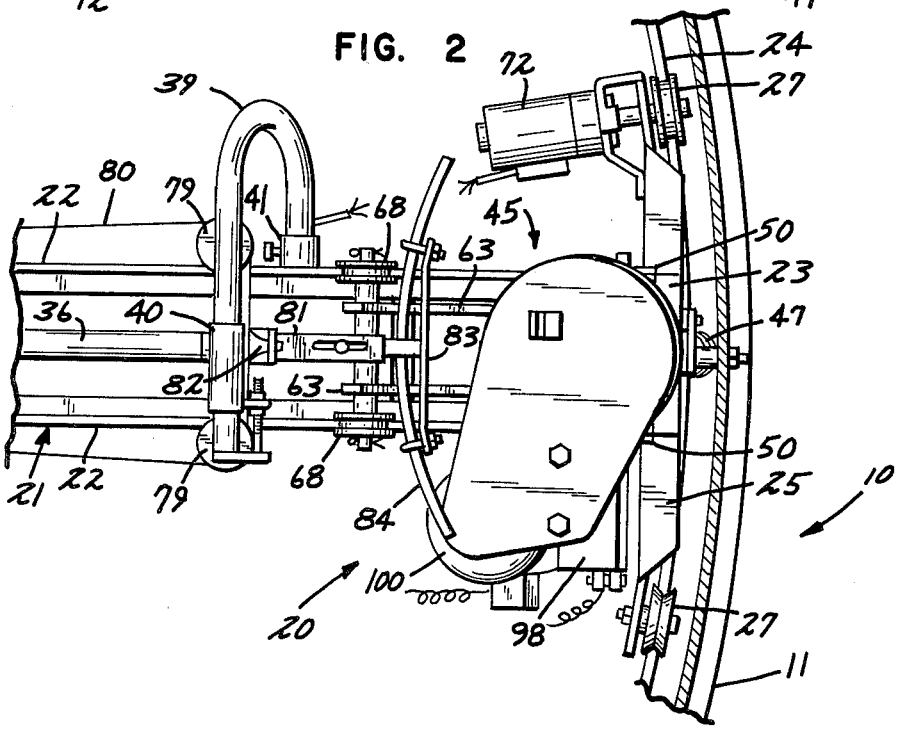
FIG. 2 is a top view, taken along line 2—2 of FIG. 1, showing the trolley in relation to other mechanism near the bin wall.

Referring to FIG. 1, reference number 10 generally indicates a cylindrical drying container or bin typically utilized in the drying of grain or other like harvested crops. Inside bin 10 there is shown grain 12 and a grain stirring device generally indicated by the numeral 20 which includes a support mechanism in the nature of a bridge frame 21 having a pair of laterally spaced rails 22 connected at opposite ends thereof by crossmembers 23. A circular track 24 is mounted near the upper end of the wall 11 of the container 10 and provides a support for the outer end of the bridge frame 21. Frame 21 extends radially of bin 10 moving about a vertical axis in an orbital path above material 12. A carriage 25 is pivotally secured to the outer end of the bridge frame 21 and supported on the circular track 24 for movement therealong by a pair of grooved wheels 27 rotatably carried by the carriage 25 at longitudinally spaced opposite ends.

The inner end of bridge frame 21 is suspended by a flexible mechanism in the nature of a plurality of chains or cables 30 engaged at one end in the opening 18 using hook elements 31. A generally horizontally disposed T-bar 32 is adjustable secured to the end portions of chains 30. A depending shaft 34, supported by the T-bar 32, in turn supports generally rectangular enclosure 35 on the inner end of a longitudinally extended frame element 36. A gooseneck portion 37 of frame 36 depends from the enclosure 35 and is rotatably mounted to the inner end of the bridge frame 21, as at 38. A yoke 39 is pivotally secured to the outer end of the frame element 36, as at 40, and fixedly secured to one of rails 22 of the bridge frame 21, as at 41.

Numeral 45 generally indicates a trolley mounted on the bridge frame 21 for movement longitudinally therealong in directions radially toward and away from the wall 11 of the container 10. The trolley 45 includes depending leg 46, positioned between the rails 22, which forms an auger support means for a stirring auger 47. A first pair of laterally spaced groove wheels 50 are rotatably mounted on the upper end of the depending leg 46 in a manner to engage an upper edge of each of the rails 22 and support the trolley 45 for movements along the bridge frame 21. A second pair of laterally spaced wheels 68 is mounted on the opposite end of the trolley arm 63 for rotation on an axis parallel to the axis of rotation of the wheels 50. Roller elements 69 are rotatably carried by the trolley arm 63 in a manner to engage an under surface of the rails 22. The above-described structure generally coincides with that disclosed in U.S. Pat. 3,580,549 and further detailed description relative thereto is eliminated in the interest of brevity.

A drive mechanism, connected to move the bridge frame 21 in its orbital path of travel, includes a gear head electrical motor 72. Geared motor 72 is mounted to one end of the carriage 25 with rotary output shaft thereof having one of the grooved wheels 27 fixedly secured thereto for driving engagement along the circular track 24.

A second drive mechanism connected to move the trolley 45 radially toward and away from the wall 11 includes a sheave 78 which is rotatably mounted on depending shaft 34. A pair of rotatable sheaves 79 are mounted on the yoke 39 for rotation on vertical axes. Sheaves 79 are spaced from each other transversely of the bridge frame 21 and from the sheave 78 longitudinally of the bridge frame 21. An endless flexible drive element 80 is entrained over sheaves 79 and sheave 78. A connection between the drive element 80 and the trolley 45 is made with a pitman arm 81. Pitman arm 81 is connected at one end thereof to a fixed point on the flexible drive element 80 by a pivotal connection 82. The other end of the pitman arm 81 includes a cross head 83 which is slidably mounted to an arcuate element 84 fixedly connected to the trolley arm 63 as at 85. Arcuate element 84 is mounted to extend transversly of the bridge frame 21.

In order to impart movement to the fixed point or pivotal connection 82 of flexible drive element 80 and consequently, movement of the pitman arm 81 and trolley 45 longitudinally of the bridge frame 21, sheave 78 is immobilized relative to the rotation of the bridge frame 21 about the vertical axis of the bin 10. To immobilize the sheave 78 an arm 90 is fixedly mounted on the depending shaft 34 to extend radially to the sheave 78 and closely underlying relationship thereto. A detachable mechanism, in the nature of a metal loop 91, is pivotally carried by the sheave 78 and is adapted to engage the outer end of the radial arm 90 to prevent rotation of the sheave 78. Immobilizing of the sheave 78 causes the drive element 80 to wrap about the pulley 78 and the fixed point or pivotal connection 82 to travel in a path between the sheaves 79 and between the sheave 78 and sheaves 79. It will be appreciated that such movement of the fixed point or connection 82 between the sheaves 78, 79 causes the trolley means 45 to move longitudinally of the bridge frame 21 and that movement of the fixed point between the sheaves 79 positions the trolley means 45 at the outer end of the bridge frame 21 with little or no movement longitudinally of the bridge frame 21 during orbital movement of the bridge frame in the container 10.

An electric motor 100 provides drive means for imparting rotation to the auger 47. Motor 100 is mounted on the trolley means 45 in cantilever fashion by means of a laterally projecting plate 98.

Figure 7:
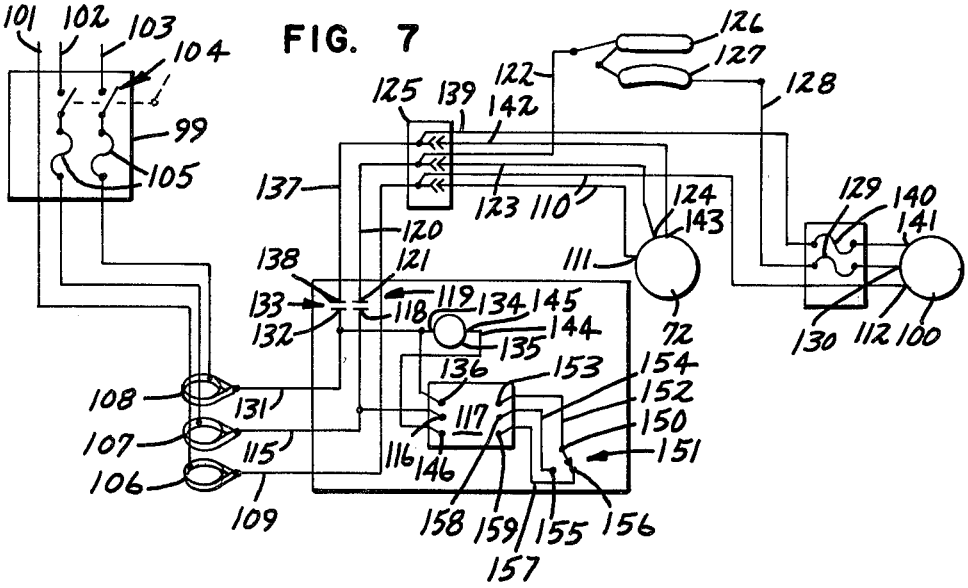
FIG. 7 is a schematic diagram illustrating electrical connections in accordance with the present invention.

Referring now to FIG. 7 there is shown schematically a wiring diagram of the electrical connections for a single auger according to the present invention. A power source (not shown) comprising the ground 101 and ac voltage lines 102 and 103 are passed through switch 104 and fuses 105 of fuse switch box 99 to swivel slip ring connectors 106, 107, and 108 respectively. Swivels 106-108 are mounted within the rectangular enclosure 35. Switching mechanism 104 is normally mounted on the T-bar 32. Ground line 101 is connected via conductor 109 from swivel connector 106 to receptacle 125. Conductors 110 connect from the other side of receptacle 125 to the ground terminals 112 and 111 of the respective auger motor 100 and gear motor 72.

Conductor 115 connects swivel 107 to terminal 116 of solid state timer 117 and to terminal 118 of relay 119. Conductor 120 connects from terminal 121 of relay 119 to receptacle 125. Conductor 123 connects from the corresponding output terminal of receptacle 125 to terminal 124 of gear head motor 72. Conductor 122 depends from the same terminal of receptacle 125 and is connected to mercury switches 126 and 127. Conductor 128 connects mercury switch 127 through fuse 129 and to terminal 130 of auger motor 100.

Conductor 131 connects to swivel connector 108 and to terminal 132 of relay 133. Conductor 131 is further connected to terminal 134 of relay coil 135 and to terminal 136 of solid state timer 117. Conductor 137 connects from terminal 138 of relay 133 to receptacle 125. Conductor 139 connects from the side of receptacle 125 corresponding to conductor 137 through fuse 140 to terminal 141 of auger motor 100. Conductor 142, which is connected to the same terminal as connector 139 connects to terminal 143 of gear motor 72.

Conductor 144 connects from terminal 145 of relay coil 135 to terminal 146 of timer 117. Terminal 150 of microswitch 151 connects through conductor 152 to terminal 153 of said timer. Terminals 155 and 156 of microswitch 151 are connected through conductors 154 and 157 to the respective terminals 158 and 159 of timer 117.

Figure 3:
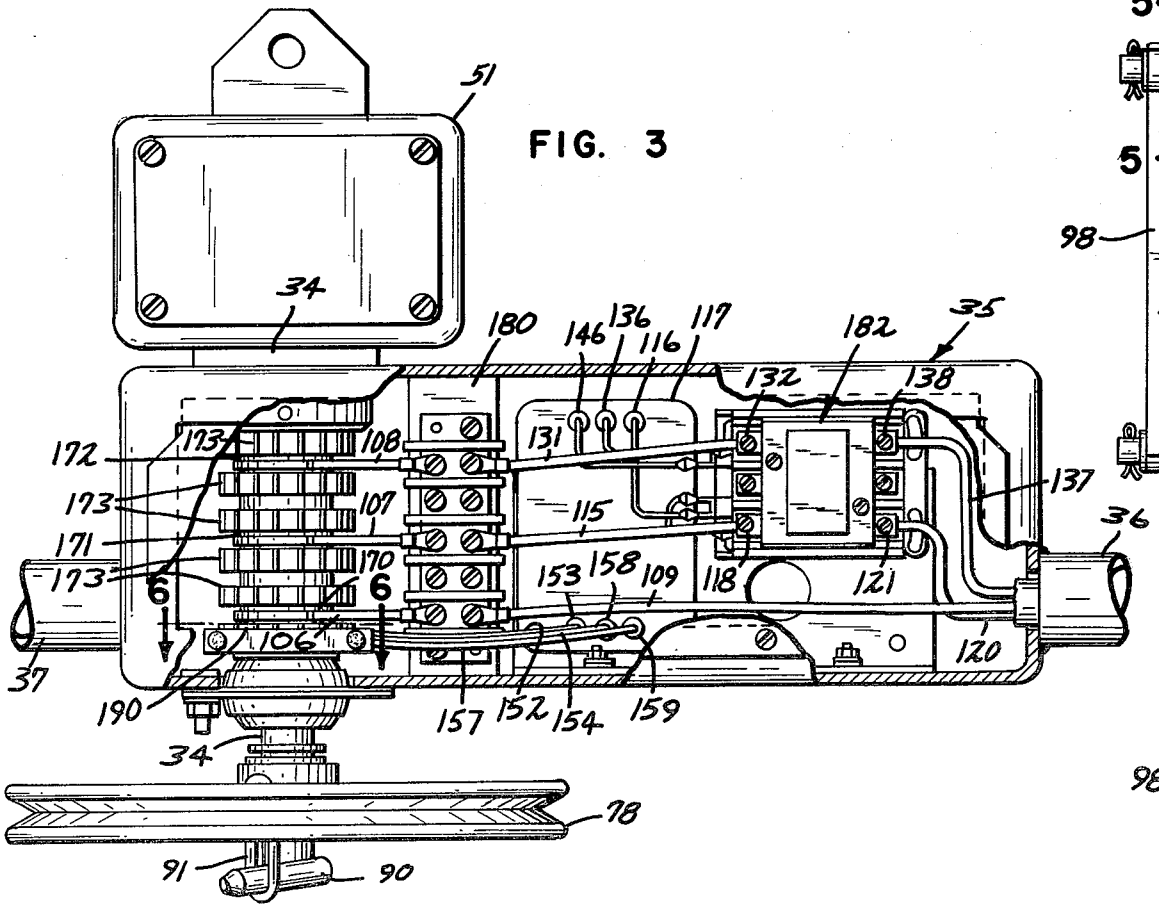
FIG. 3 is a partially cut away side view of the enclosure housing apparatus in accordance with the present invention.

Referring now to FIG. 3 there is shown an elevational fragmentary view of enclosure 35. The electrical components shown in the enclosure generally correspond to those schematically illustrated in FIG. 7. Junction box 51 connects power lines 101, 102 and 103 to the respective circular contacter plates 170, 171 and 172 which are circumferentially mounted on shaft 34. As described with regard to FIG. 1, enclosure 35 rotates about shaft 34 as frame 21 orbits grain bin 10. Washers 173 separate and maintain swivel connectors 106-108 in position with contactors 170-172. Terminal block 180 connects swivel connectors 106-108 to the respective conductors 109, 115 and 131.

The electronic components and their terminals have reference numbers corresponding directly to those of the appropriate portions of FIG. 7. It should be noted that relay coil 135, and contacts 133 and 119, are mounted within relay housing 182.

Figure 6:
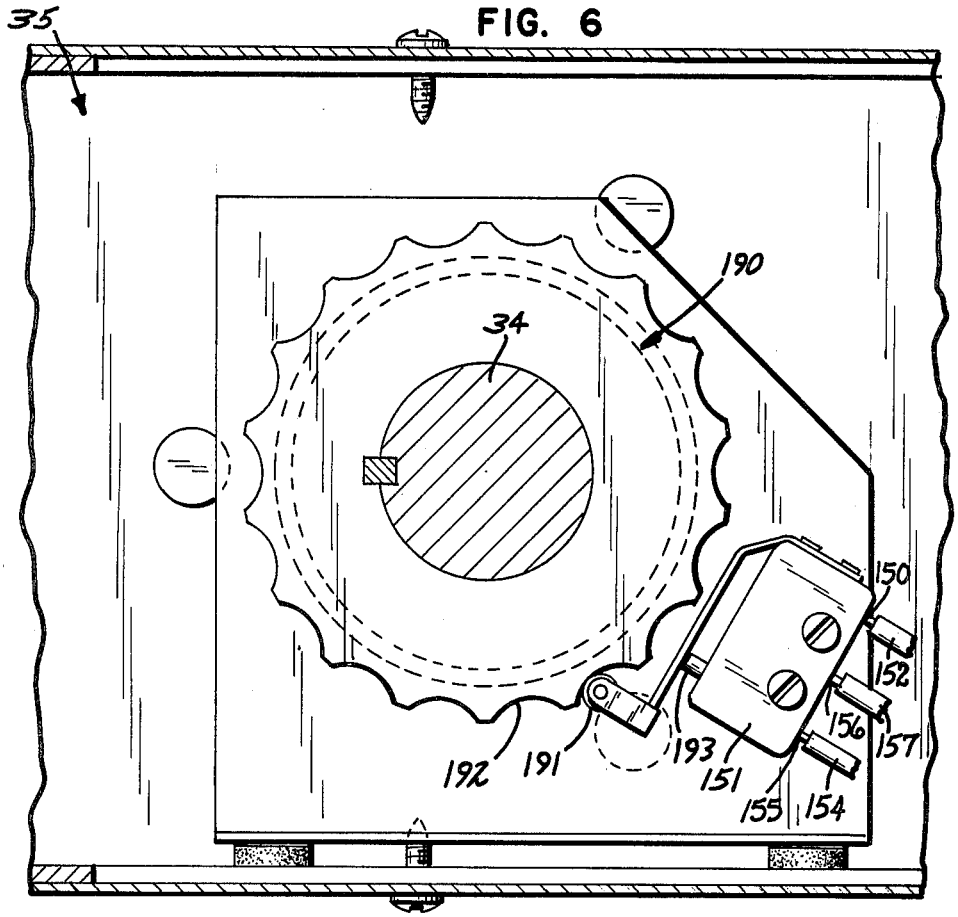
FIG. 6 is a sectional view taken along line 6—6 of FIG. 3 showing microswitch mechanism cooperating with cam mechanism.

Referring now to FIG. 6, there is shown gear tooth cam 190 and microswitch 151. During the orbiting of journal box 35 about the shaft or pivot axis 34, roller bearing 191 of microswitch 151 rides the cam surface 192. As the enclosure 35 rotates about the pivot axis 34, plunger 193 is depressed when roller bearing 191 traverses the apex of a cam gear tooth. Depression of plunger 193 causes a circuit path from terminal 150 to terminal 155. When plunger 193 is fully extended, a circuit path exists between terminal 150 and terminal 156.

Although the present embodiment is described with cam 190 located on shaft 34 and switch 151 orbiting thereabout, it is to be understood that switch 151 and cam 190 could be interchanged such that cam 190 orbits about switch 151. It is further understood that an actuating mechanism other than a cam may operate a switch equally well and that switch 151 could be located other than near or on shaft 34. For example, switch 151 could be located near track 24 and actuated periodically by the brackets (not shown) which attach track 24 to bin 10.

Figure 4:
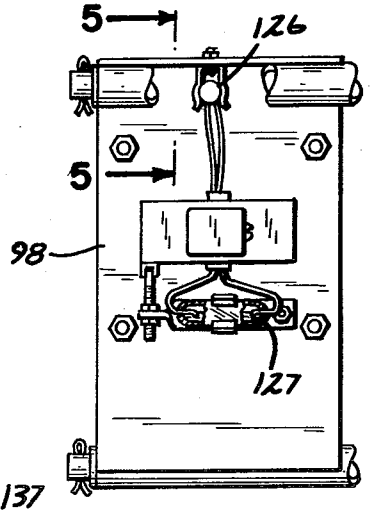
FIG. 4 is an enlarged view in elevation of a portion of the grain stirring device of FIG. 1 illustrating mechanism for controlling the degree of inclination of the auger relative to the vertical axis.
Figure 5:
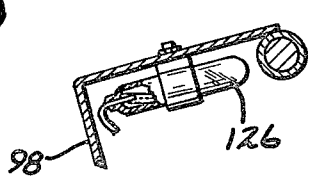
FIG. 5 is a view in vertical section as seen from line 5—5 of FIG. 4.

Referring to FIG. 4, there is shown the mechanism for controlling the degree of inclination of the auger relative to a vertical axis. Mercury switches 126 and 127 correspond to those switches illustrated and identified with the same reference numbers in FIG. 7. FIG. 5 is another view of mercury switch 126. The operation of these switches is more fully explained by the above-identified prior patent.

Referring generally to FIGS. 6 and 7 the operation of the present invention will now be explained. The energization of motors 72 and 100 and consequently the turn-on of the grain stirring device for operation is accomplished by actuating ac power switch 104. Upon closing switch 104 power is delivered to the various circuits of FIG. 7 through swivel connectors 106-108. Upon initial power-up of solid state timer 117 via conductors 115 and 131 and the respective terminals 116 and 136, timer 117 applies a low level signal to terminal 145 of relay coil 135 from its output terminal 146 through conductor 144. As the other side of coil 135 is connected to an ac power source at terminal 134 through conductor 131, coil 135 energizes and causes contacts 119 and 133 to close. A path is thereby provided from conductor 131 to 137 and from conductor 115 to 120, delivering the AC power necessary to drive motors 72 and 100 via conductors 122, 123, 139 and 142. Timer 117 continues to ouput a coil energizing signal on conductor 144 for a predetermined time period, 45 minutes in the preferred embodiment, and in the absence of a reset signal from microswitch 151 the relay energizing signal is terminated at the end of said period.

During normal operation, a reset signal is applied to timer 117 before coil deenergization occurs. The reset signal required to maintain power continuity is recurringly generated by microswitch 151 and gear tooth cam 190. Normally, the time required for roller bearing 191 to travel from one gear tooth to the next and thereby generate a reset signal path between terminals 158 and 153 of timer 117 is less than the predetermined time period of timer 117. In this manner AC power is delivered to motors 72 and 100 continuously and without interruption.

In the case where microswitch 151 fails to rotate about pivot shaft 34 due to a malfunction or failure in the drive mechanism of bridge frame 21, timer 117 does not receive the necessary reset signal to maintain continuity of power to motor 72 and 100. More specifically, the relay energizing signal to coil 135 is terminated at the end of the predetermined time period thereby opening contacts 133 and 119 which in turn terminates the supply of ac power to motors 72 and 100. To restart the stirring unit main power switch 104 is opened and reclosed.

The present invention is described hereinbefore with reference to existing grain stirring apparatus as described in U.S. Pat. No. 3,580,549. An electrical embodiment of the present invention is also described. It is to be understood, however, that the present invention is equally applicable to other grain stirring devices and that the present invention is not limited to an electrical embodiment since fluid, pneumatic or mechanical devices may function in a similar fashion to accomplish similar results. Consequently, although numerous characteristics and advantages of a preferred embodiment, together with details of the structure and function, have been described in this disclosure, it is to be understood that the disclosure is illustrative. Any changes made, especially in matters of shape, size and arrangement, to the full extent extended by the general meaning of the terms in which the independent claims are expressed, are within the principle of the invention.

What is claimed is:

1. Apparatus for controlling delivery of power to a material-stirring device mounted in a material storage container, said material-stirring device having means for stirring said material and means for moving said stirring means about said container, said stirring means and said moving means being driven by said power, said apparatus comprising;

means for sensing movement of said moving means; and means for interruptably connecting said power to said stirring means, said connecting means being controlled by said sensing means;

whereby when said sensing means senses absence of movement of said moving means, said connecting means interrupts power to said stirring means, thereby protecting said material from harmful overstirring.

2. Apparatus for controlling delivery of power to a grain stirring device mounted in a grain storage bin, said grain stirring device having means for stirring said grain and means for moving said stirring means about said bin, said stirring means and said moving means being driven by said power, said apparatus comprising:

means for sensing movement of said moving means;

means for timing a predetermined time interval, said timing means including means for resetting said time interval, said resetting means being controlled by said sensing means; and means for interruptably connecting said power to said stirring means, said connecting means being controlled by said timing means;

whereby when said sensing means senses absence of movement of said moving means for said predetermined time interval, said connecting means interrupts power to said stirring means, thereby protecting said grain from harmful overstirring.

3. Apparatus in accordance with claim 2, wherein said sensing means includes a switch and means for actuating said switch, said switch and said actuating means being attached to different ones of said moving means and said bin.

4. Apparatus in accordance with claim 2 wherein said stirring means includes an auger and said moving means includes central support means and auger support means depending from said central support means, and wherein said sensing means includes a cam and a switch, one of said cam and said switch being mounted on said central support means and the other of said cam and said switch being mounted on said auger support means, said switch having a cam follower for contacting said cam and actuating said switch in response to incremental orbital movement of said auger support means about said central support means, the switch actuation producing a signal for controlling said resetting means of said timing means.

5. Apparatus for controlling delivery of power to a grain stirring device mounted in a grain storage bin, said grain stirring device having means for stirring said grain and means for moving said stirring means about said bin, said mixing means including an auger, said moving means including central support means and auger support means depending therefrom, said mixing means and said moving means being driven by said power, said apparatus comprising:

switching means mounted on said auger support means;

cam means for actuating said switching means, said cam means being mounted on said central support means proximate said switching means, said switching means producing a signal whenever actuated by said cam means, said signal being indicative of movement by said auger support means;

means for timing a predetermined time interval, the time interval being reset by the signal from said switching means; and means for interruptably connecting the power to said mixing means, said connecting means interrupting power to said mixing means and moving means whenever said timing means times a time interval without being reset;

whereby stalling of said auger support means for a period equal to the predetermined time interval causes power interruption to said grain stirring device.

* * * * *